US005411264A

United States Patent [19]

Oku

[11] Patent Number: 5,411,264

[45] Date of Patent: May 2, 1995

[54] GOLF CLUB HEAD

[75] Inventor: Yutaka Oku, Tokyo, Japan

[73] Assignee: Daiwa Golf Co., Ltd., Tokyo, Japan

[21] Appl. No.: 181,464

[22] Filed: Jan. 14, 1994

[30] Foreign Application Priority Data

Jan. 19, 1993 [JP] Japan ..... 5-974 U

[51] Int. Cl.[6] ..... A63B 53/04

[52] U.S. Cl. ..... 273/169; 273/167 F; 273/167 H; 273/173

[58] Field of Search ..... 273/78, 173, 169, 170, 273/167 R, 167 F, 167 H

[56] References Cited

U.S. PATENT DOCUMENTS 4,653,756 3/1987 Sato ..... 273/167 E 4,884,812 12/1989 Nagasaki et al. ..... 273/167 H

FOREIGN PATENT DOCUMENTS 59-82063 6/1984 Japan .

*Primary Examiner*—William H. Grieb

*Attorney, Agent, or Firm*—Longacre & White

[57] ABSTRACT

A golf club head capable of reducing the vibration of the head at the moment of its impact on a golf ball even if the sweet spot is missed, thereby improving the directional property of the ball. The golf club head includes a face plate formed of resin mounted to a face portion of a head main body formed of metal. A flange portion extending backwardly of the head main body is disposed in a back portion of the head main body in a manner to extend along the peripheral edge portion of the back portion and correspond to the peripheral edge portion of the face plate. The flange portion is projected backwardly of the head main body longer than the thickness of the flange portion.

10 Claims, 2 Drawing Sheets

GOLF CLUB HEAD

BACKGROUND OF THE INVENTION

The present invention relates to an improved golf club head which can enhance the directional property of a golf ball when it is hit.

Generally, in the head of an iron golf club, a hosel portion, a sole portion, a face portion and the like are formed integrally of metal such as soft iron, stainless steel or the like.

However, conventionally, although a golf club head of this type is designed to have such shape and weight as correspond to the number thereof, because the golf club head is formed of a mass of metal, it is lacking in elasticity. In particular, if the face portion of the golf club head that plays the most important role in impacting on a golf ball is lacking in elasticity, then the repulsive coefficient thereof is small and also a golf club having such head cannot provide such a soft hitting feeling as a wood club.

In view of the above, in recent years, there has been proposed a golf club head in which a face plate formed of resin is mounted to a face portion of a head main body formed of metal, in order to extend a ball flying distance and obtain a soft hitting feeling, as disclosed in Japanese Utility Model No. 59-82063 of Showa.

FIGS. 3 and 4 show a golf club head which is disclosed in the above-mentioned Japanese Utility Model No. 59--82063 of Showa. In this golf club head 1, a plate-like cut-off portion 11 extending from a top portion 7 to a sole portion 9 is formed in a face portion 5 of a head main body 3 formed of metal, and a face plate 13 formed of fiber reinforced resin consisting of a combination of reinforcing fiber and synthetic resin material is mounted on the plate-like cut-off portion 11. In this structure, the flying distance of a hit golf ball can be extended by means of the elastic deformation of the face plate 13 and at the same time a soft hitting feeling can be obtained at the moment of the impact on the ball against the golf club head.

Also, as a back portion 15 of the head main body 3 is generally referred to as a cavity back, a recess-like cavity 17 is formed in the back portion 15, except for a peripheral portion 15 thereof. By forming the cavity 17 in the back portion 15 in this manner, the elastic deformation of the face plate 13 is facilitated so as to secure the longer flying distance of the hit ball.

However, in the conventional golf club head of the above-mentioned type, if a player misses the sweet spot of the club head, then the head is vibrated at the time when the head impacts a golf ball, and also the elastic deformation of the face plate of the head is put out of balance, with the result that the directional property of the ball is worsened.

SUMMARY OF THE INVENTION

The present invention aims at eliminating the drawbacks found in the above-mentioned conventional golf club head. Accordingly, it is an object of the invention to provide a golf club head which, even if the sweet spot of the club head is missed, is able to minimize the vibration of the head occurring at the moment of the impact on a golf ball to thereby improve the directional property of the golf ball when it is hit by the club head.

In order to attain the above-noted and other objects, the present invention provides a golf club head including a face plate mounted to a face portion of a head main body, wherein there is provided in the back portion of the head main body a flange portion extending backwardly of the head main body in a manner to extend along the peripheral portion thereof and also to be projected backwardly of the head main body longer than the thickness thereof. Preferably, the flange portion is arranged so as to correspond to the peripheral portion of the face plate.

If a player swings a golf club provided with such a golf club head, because the moment-of inertia of the present head is larger than the conventional one, then the vibration of the head at the impact on a golf ball can be minimized even when the sweet spot of the head is missed, so that the ball can be flown toward the aimed direction.

In a feature of the golf club head according to the invention, the whole of the face plate thereof is easier to deform elastically and the sweet spot thereof is expanded, when compared with the conventional golf club head, to thereby reduce or minimize the unbalanced elastic deformation of the face plate. That is, due to the repulsion of the whole face plate, a golf ball can be flown longer with a better directional property when compared with the conventional golf club head.

In a feature of the golf club head according to the present invention, the backwardly extended flange portion contributes to increase the mass of the golf club head without deteriorating the elastic deformation function produced by a cavity back design. Further, it is possible to locate the increased mass or weight away from the ball-hitting surface, to thereby shift a center of gravity of the golf club head backwardly. As a consequence, a so-called sweet spot area on the ball hitting surface can also be widened.

DETAILED DESCRIPTION OF THE PREFERRED EMBODIMENT

Now, description will be given below in detail of an embodiment of a golf club head according to the invention with reference to the accompanying drawings.

Figure 1:
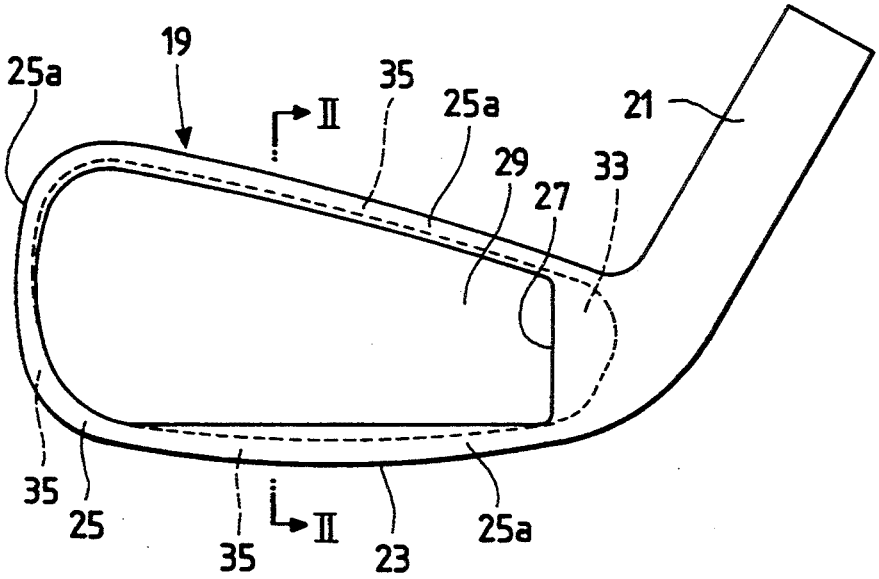
FIG. 1 is a front view of a golf club head according to an embodiment of the invention.
Figure 2:
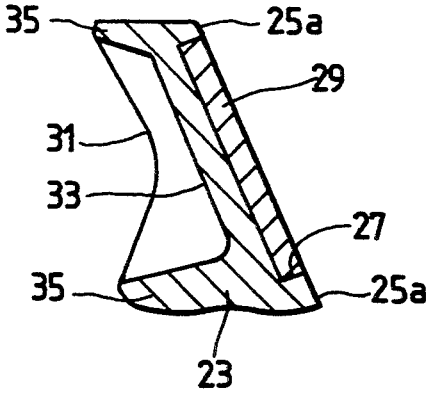
FIG. 2 is a section view taken along the line II—II in FIG. 1.

FIG. 1 shows a front view of a golf club head according to an embodiment of the invention, and FIG. 2 shows a section view of the golf club head. In the drawings, reference character 19 designates a head main body formed of metal such as soft iron, stainless steel or the like. Likewise in the conventional golf club head, the head main body 19 includes a hosel portion 21, a sole portion 23, a face portion 25 and the like which are all formed integrally together. The face portion 25 includes a recess-like fitting portion 27 except for the peripheral edge portion **25*a* thereof, and a face plate 29 is fitted into and bonded to the fitting portion 27**.

The face plate 29 is formed of highly elastic fiber reinforced resin which is a mixture of carbon fiber, glass fiber and resin material and has the same external shape as the above-mentioned fitting portion 27. Also, the face plate 29 has such a thickness as allows it flush with the face porion 25 when the face plate 29 is fitted into and mounted to the fitting portion 27.

Also, as shown in FIG. 2, similarly to the conventional golf club head, the head main body 19 includes in a back portion thereof 31 a cavity (a recessed portion) 33 which is used to permit elastic deformation of the face plate 29. In the present embodiment, a flange portion 35 extending backwardly of the head main body 19 is disposed along the peripheral edge portion of the back portion 31 in such a manner that it corresponds to the peripheral edge portion of the face plate 29, whereby there can be provided in the back portion 31 a recess-like cavity 33 almost identical in shape with the external shape of the face plate 29, as shown in FIG. 1.

And, as shown in FIG. 2, the flange portion 35 is arranged such that it projects backwardly of the head main body 19 longer than the thickness of the flange portion 35. That is, due to provision of the flange portion 35 which extends long along the peripheral edge-portion of the back portion 31 and backwardly of the head main body 19, when compared with the conventional golf club head, the moment of inertia of the present golf club head is increased when it is swung and at the same time the balance of the whole head main body 19 is improved.

Due to the fact that the golf club head according to the present embodiment is structured in this manner, when a player swings such a golf club as including present golf club head, because the golf club head according to the present embodiment is larger in the moment of inertia than the conventional golf club head, then the vibration of the present golf club head occurring at the moment of its impact on a golf ball can be reduced even if the sweet spot is missed, with the result that the ball can be flown in the aimed direction.

Figure 3:
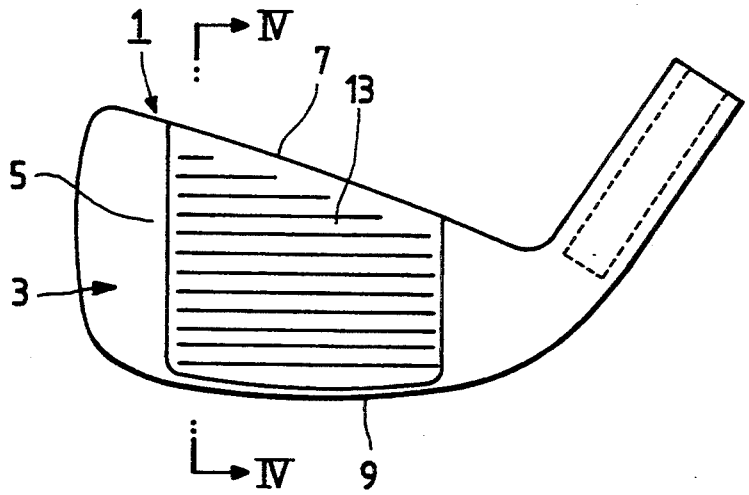
FIG. 3 is a front view of a conventional golf club head.
Figure 4:
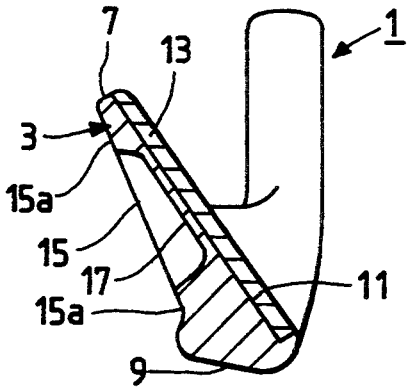
FIG. 4 is a section view taken along the line IV—IV in FIG. 3.

Further, as described above, since in the back portion 31 of the head main body 19 there is formed the cavity 33 substantially identical in shape with the external shape of the face plate 29, when compared with the conventional golf club head as shown in FIGS. 3 and 4, the whole of the face plate 29 can be elastically deformed more easily, the sweet spot thereof can be expanded, and the unbalanced elastic deformation of the face plate 29 can be reduced, so that the golf ball can be flown longer with a better directional property due to the repulsion of the whole face plate 29.

In this manner, according to the present embodiment, in the back portion 31 of the head main body 19, the flange portion 35 extending backwardly of the head main body 19 longer than the conventional one is disposed along the peripheral edge portion of the back portion 31 to thereby be able to increase the moment of inertia of the present golf club head when the golf club including the present golf club head is swung. Thanks to this, the head can be stabilized at the moment of its impact on the ball and thus the directional property of the ball can be improved over the conventional one.

Also, according to the present embodiment of the invention, by providing the flange portion 35 in the back portion 31 of the head main body 19 in such a manner that the cavity 33 is substantially identical in shape with the outward form of the face plate 29, the face plate 29 can be elastically deformed more easily and the sweet spot thereof can be expanded to thereby be able to reduce the unbalanced elastic deformation of the face plate 29, so that both the directional property and flying distance of the ball can be improved.

In addition, although the above-noted embodiment employs a face plate made of fiber reinforced resin, the invention should not be restricted thereto or thereby. The face plate may be made of other non-metallic or metallic material different from that forming the head main body as far as it provides a suitable elastic deformation property or characteristic.

As noted above, according to the present invention, since the moment of inertia of the present golf club head in swinging is increased when compared with that of the conventional golf club head, the head can be stabilized at the moment of its impact on the ball and thus the directional property of the ball can be improved. Further, the flying distance of the ball can be improved.

What is claimed is:

1. A golf club head having a face portion of a head main body, said golf club head comprising:

a face plate mounted to the face portion and formed of material different from that of the head main body;

a flange portion extends from an entire peripheral edge of said head main body to provide a cavity in a back portion of said head main body, said cavity is approximately congruent with respect to said face plate; and said flange portion projects backwardly of said head main body longer than the thickness of said flange portion so as to increase a mass of said golf club head while distributing the increased weight of said head main body backwardly away from said peripheral edge of said main body.

2. The golf club head as set forth in claim 1, wherein said head main body is formed at said face portion with a recess-like fitting portion to which said face plate is securely fitted.

3. The golf club head as set forth in claim 2, said cavity is deeper than said recess-like fitting portion.

4. The golf club head as set forth in claim 2, wherein a distance between bottoms of said cavity and said recess-like fitting portion is substantially constant.

5. The golf club head as set forth in claim 2, wherein the head main body extends between and completely separates said cavity and said recess-like fitting portion.

6. The golf club head as set forth in claim 1, wherein said face plate is made of fiber reinforced resin.

7. The golf club head as set forth in claim 1, wherein said cavity is circumscribed by said flange portion.

8. The golf club head as set forth in claim 7, wherein a shape of perimeter of said cavity is substantially identical to that of said face plate.

9. The golf club head as set forth in claim 1, wherein said flange portion projects backwardly of said head main body most from a sole position of said head main body.

10. The golf club head as set forth in claim 9, wherein said flange portion projects backwardly of said head main body least from a heel position and a toe position of said head main body.

* * * * *